United States Patent [19]

Ammann

[11] Patent Number: 4,748,650

[45] Date of Patent: May 31, 1988

[54] X-RAY DIAGNOSTIC INSTALLATION COMPRISING AN X-RAY TUBE

[75] Inventor: Ernst Ammann, Bubenreuth, Fed. Rep. of Germany

[73] Assignee: Siemens Aktiengesellschaft, Berlin and Munich, Fed. Rep. of Germany

[21] Appl. No.: 948,423

[22] Filed: Dec. 30, 1986

Related U.S. Application Data

[63] Continuation of Ser. No. 682,329, Dec. 17, 1984.

[30] Foreign Application Priority Data

Jan. 19, 1984 [DE] Fed. Rep. of Germany ..... 3401749

[51] Int. Cl.[4] ..... H01J 35/14

[52] U.S. Cl. ..... 378/137; 378/113; 378/138

[58] Field of Search ..... 378/113, 137, 10, 138

[56] References Cited

U.S. PATENT DOCUMENTS 4,426,722 1/1984 Fujimura ..... 378/138

*Primary Examiner*—Janice A. Howell
*Assistant Examiner*—David P. Porta
*Attorney, Agent, or Firm*—Hill, Van Santen, Steadman & Simpson

[57] ABSTRACT

In an exemplary embodiment a fine electron beam is generated which impinges on an elemental part of an anode focus region. A beam deflection system is controlled by a control circuit such that the point of impingement of the electron beam on the anode focus region moves along a predetermined path whose configuration effectively determines the desired focus size and shape.

9 Claims, 3 Drawing Sheets

X-RAY DIAGNOSTIC INSTALLATION COMPRISING AN X-RAY TUBE

BACKGROUND OF THE INVENTION

The invention relates to an x-ray diagnostic installation, comprising an x-ray tube having a cathode, focusing means for the electron beam, and an anode, wherein deflection means for the electron beam are present which are connected to a control circuit which is so designed that the impingement point of the electron beam on a focal region describes a predetermined path to define the effective focus shape and size.

In the operation of x-ray tubes, there is a requirement for the x-ray tube current to be very rapidly altered. Fundamentally, an alteration of the x-ray tube current by controlling the filament power is possible. However, this means of altering x-ray tube current necessitates a relatively large delay time which is not always acceptable. A very rapid alteration of the x-ray tube current is possible if a control grid is provided between the cathode and the anode of the x-ray tube. The focus must in this case have a predetermined shape and size sufficient to preclude an overloading of the anode of the x-ray tube, but not such that blurring of the x-ray image as determined by the focus dimensions becomes excessive.

From UK published patent application GB No. 2 044 489A, it is known in the case of a computer tomograph to deflect the electron beam over a region of an anode moving with the cathode about a patient such that the impingement point of the electron beam on the anode describes a predetermined scanning path. However, this path on the anode is related to a desired corresponding spacial scanning path of the x-ray beam with respect to a patient, the anode being e.g. linearly extensive to accommodate the desired scanning pattern thereon.

SUMMARY OF THE INVENTION

An object underlying the invention resides in providing an x-ray diagnostic installation with an electron beam deflection system such that the shape and size of the focus region on the anode can be adapted in a simple fashion to different requirements.

In accordance with the invention, this object is achieved in that the path of the impingement point of the electron beam on the anode is adjustable. In the case of the inventive x-ray diagnostic installation, a fine electron beam can be generated whose beam current intensity can be rapidly altered with the aid of a control electrode. In order to prevent an overloading of the anode of the x-ray tube due to a relatively small impingement point of the electron beam, the latter is electronically deflected along a predetermined path in a focus region. In this manner, it is possible to scan a focus region which corresponds to the known line focus with the aid of an electron beam. This scanning-type focus generation permits a variation of the focus size of a line-shaped type of focus in length and width. Also, one of these two dimensions can be altered, so that, given anode angles of varying size, the same focus size is rendered possible with a power per square millimeter in the anode material which is kept constant. The focus size can also be varied in length and/or width in stages or continuously. An optimum focus size with a maximum tube load, dependent upon the respective examination method or the subject to be examined, is thereby selectable.

A further development of the invention is realized in that the intensity of the electron beam during the deflection is adjusted corresponding to a predetermined function. In this manner, e. g. a focus with Gaussian intensity distribution is realizable. The adjustment of the intensity is also possible in a subject-dependent fashion. For this purpose, radiation detectors can be provided which serve the purpose of actual value determination of the respective radiation intensity.

The invention shall be explained in greater detail in the following on the basis of an exemplary embodiment illustrated on the accompanying drawing sheets; and other objects, features and advantages will be apparent from this detailed disclosure and from the appended claims.

DETAILED DESCRIPTION

Figure 1:
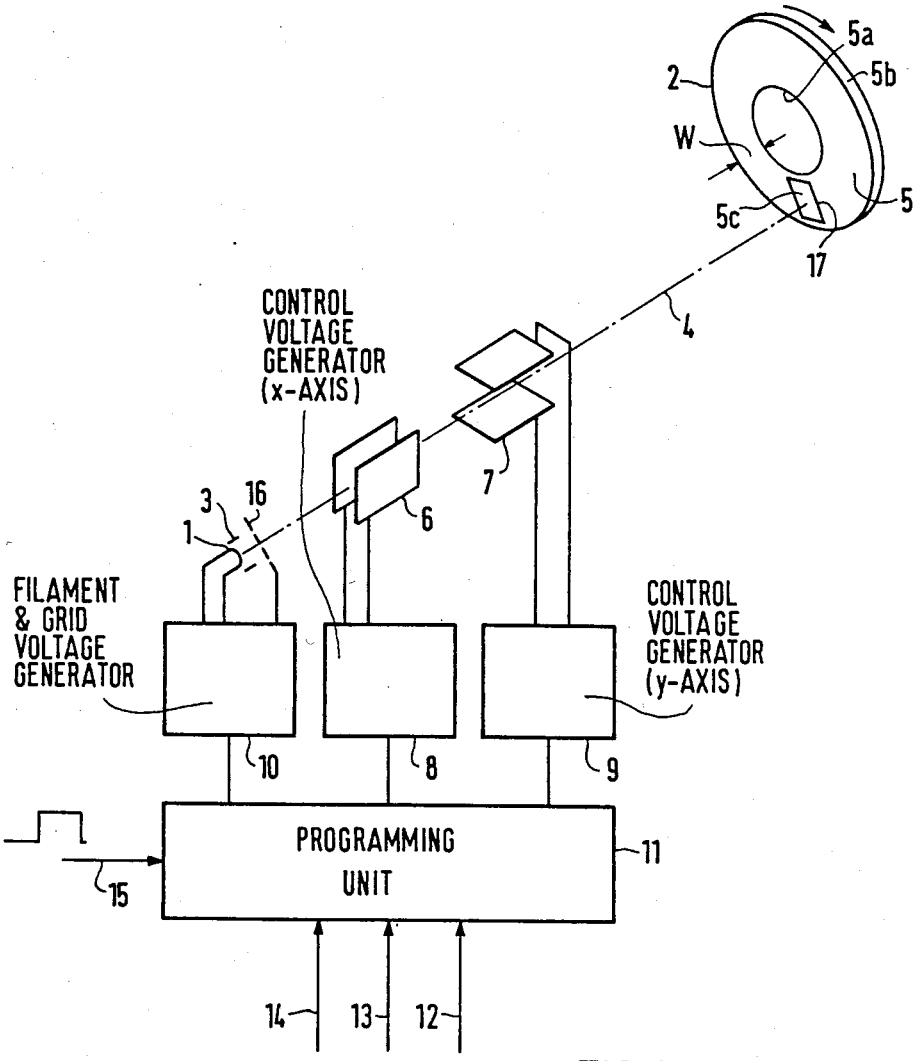
FIG. 1 shows an x-ray diagnostic installation according to the invention.

In FIG. 1, a cathode 1 and an anode 2 of an x-ray tube are illustrated, which anode is formed by a rotating anode plate. The cathode 1 emits, with the aid of focusing electrodes 3, a filament-shaped electron beam 4 which strikes the focal spot path 5 of the anode 2. The electron beam 4 is deflectable by deflection electrodes 6, 7, in two mutually perpendicular directions, the electrodes being connected to control voltage generators 8, 9. The cathode 1 is supplied by a filament voltage generator 10. The filament voltage generator 10 and the control voltage generators 8, 9 are connected to a programming unit 11 to which information regarding the desired focus size and shape is supplied at an input 12, information regarding the power per square millimeter on the anode 2 is supplied at an input 13, and information regarding the intensity distribution in the focus is supplied at input 14. In addition, an on-off-signal is supplied to an input 15.

For carrying out a radiograph, upon commencement of an on-signal at the input 15, corresponding to the signals at the inputs 12 through 14, the electron beam 4 is deflected in such a fashion that it follows a desired path defining a specified focus size and shape. The deflection of the beam 4, for example, according to FIG. 2, causes scanning of a focus region 17 to proceed along a meander path in x- and y-directions as indicated by the solid line 18 in FIG. 2. The scan frequency for the focus region 17 can be constant or variable. It can be determined in a subject-dependent fashion and/or in dependence upon the selected examination method. It is thereby possible to optimally adapt (or match) the shape and size of the focus region 17 to the respective requirements. The intensity distribution in the focus region 17 can be fixed, but also variable.

Figure 2:
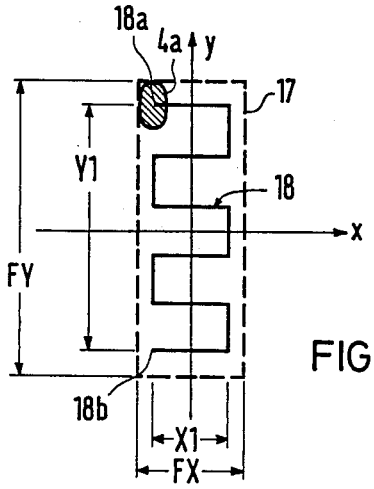
FIG. 2 shows a focus shape of the x-ray diagnostic installation according to FIG. 1.
Figure 3:
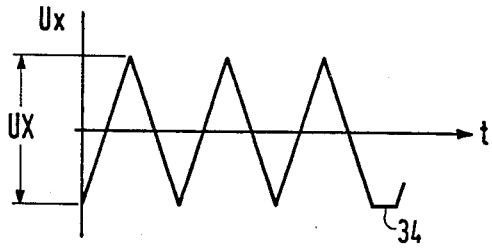
FIGS. 3 through 5 show curves for explaining FIGS. 1 and 2.
Figure 4:
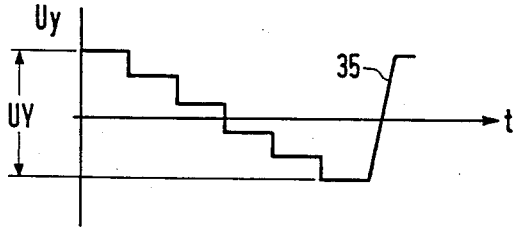

FIG. 3 shows, for the focus path shape 18 according to FIG. 2, the chronological progression of the voltage Ux at the deflection electrodes 6, and FIG. 4 shows the chronological progression of the voltage Uy for the focus path shape 18 according to FIG. 2 at the deflection electrodes 7.

Figure 5:
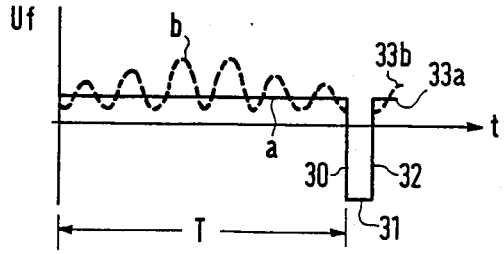

In FIG. 5, curve a shows the chronological progression of the voltage on a control grid 16 which fixes the intensity of the electron beam 4 for the instance in which this intensity is constant during the exposure time interval T during which a radiograph is being produced. The curve b shows a variable intensity progression which can be selected e. g. in a subject-dependent fashion and which is selected by the signal at the input 14.

FIG. 1 shows the focus region 17, scanned by the electron beam 4 on the anode 2, which focus region is illustrated by dash line 17 in FIG. 2. This focus region can be scanned once during the radiographic exposure time T, as is apparant from FIGS. 2 through 5. However a repeated multi-scanning of path 18 during the radiographic exposure time is also possible.

This installation also makes it possible, e. g. for stereo operation, to generate, with a single cathode, two focuses at the anode.

An exemplary electron beam spot size is indicated at 4*a* in FIG. 2. The dimension of the spot 4*a* in the x-direction is small in comparison to dimension FX of the focus region 17; for example the dimension FX is more than twice as great as the x-dimension of the electron spot 4*a*, while as shown, the dimension FY may be six times the Y dimension of spot 4*a*. For example, the dimension FX may be four times the x-dimension of the electron spot 4*a*. Then as the spot 4*a* moves such that its center point follows the deflection path 18, the electron spot will substantially uniformly cover the area of the focus region 17.

If the exposure time T is reduced by one-half then for the same deflection path, the frequencies of the waveforms of FIG. 3 and FIG. 4 would be doubled, so that the entire area of focus region 17 would again be covered only once.

Figure 6:
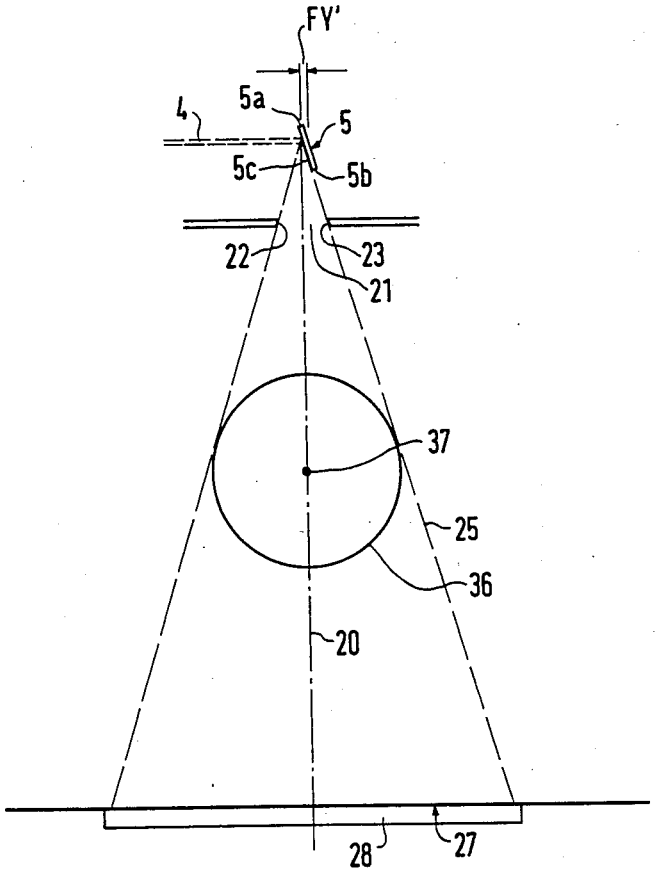
FIG. 6 is a diagrammatic view showing an exemplary path for an x-ray beam as produced by the arrangement of FIGS. 1 and 2.

If the exposure time T is doubled, the waveforms for Ux and Uy could have the same frequency as shown in FIGS. 3 and 4, and thus two cycles of each waveform would occur during the greater exposure time and the focus region 17 would be covered twice, i.e. beginning at 18*a*, progressing to 18*b* along path 18, then quickly returning to point 18*a* and retracing path 18 a second time, so that the focus region 17 is uniformly covered exactly twice; in this case a resultant pulse of x-ray energy has the dimensions determined by aperture 21, FIG. 6, but the resultant image is actually formed on the image region by superimposing the successive instantaneous images, all images being substantially coextensive (within a tolerance corresponding to the permissible degree of lack of sharpness of the x-ray image at the image region). The film or other medium at the image region integrates or sums the successive low energy coextensive x-ray images as they are formed so that upon completion of an exposure interval, the resultant image of final intensity has been formed on the film or other image sensing means at the image region.

To reduce the size of the focus region 17 in the x and/or y direction, FIG. 2, the program unit 11 may control digital to analog converters in components 8 and 9 to correspondingly adjust the excursion magnitude UX and/or UY, FIGS. 3 and 4. For example, the program unit may have UX and UY registers which are loaded with digital values representing the desired focus region dimensions FX and FY. For example if a value of ten in each register would result in the excursions X1 and Y1, FIG. 2, then loading values of five in the UX and UY registers would reduce the excursion of Ux and Uy, FIGS. 3 and 4 by one-half. In this case, the electron beam spot 4*a* could be reduced in its y-dimension by one-half so as to avoid overlap of the successive movements of the electron beam in the x-direction, e.g. as taught in U.S. Pat. No. 4,373,144 issued Feb. 8, 1983.

To vary the focus size during an exposure, the exposure time could be divided into equal subintervals, and the UX and UY registers then loaded with successive values from a FIFO (first-in, first-out) register stack or shift register at the successive subintervals. The path 18, FIG. 2, could be traversed once during each subinterval, for example.

Interlaced scanning paths covering focus region 17 could also be provided for the case where the same size spot 4*a* was to scan a focus region of twice the FY dimension during an even number of traversals of the FY dimension.

By way of example, the programming unit may include a read only memory for storing in digital form a function such as represented at b in FIG. 5. The exposure interval T would then be subdivided into twenty-seven or more subintervals, a respective stored digital value of the desired function b being read out from the memory for each subinterval and supplied to a digital to analog converter of component 10 whose output would control the potential of grid 16, FIG. 1. In this case, the pulse at input 15 would cause transmission of the initial analog value of waveform b to the control grid 15, e.g. by activating an analog gate at the output of the control grid digital to analog converter for the time interval T. Such memory controlled function generators are well known in the art.

In the case of FIG. 1 herein where the focus is stationary relative to the anode axis of rotation during an electron beam cycle, e.g. occupying a stationary region 17, FIG. 1, the focus region 17 will have a dimension FY, FIG. 2, radially of the rotating target material 5 which does not exceed the radially directed width dimension W, FIG. 1, between inner perimeter 5*a* and outer perimeter 5*b* of the target material 5. The width dimension W will not be greater than an inch or two even where the target surface 5*c* forms a relatively steep angle to the central x-ray axis such as indicated at 20 in FIG. 6. As shown in FIG. 6, the apparent or projected focus dimension FY' in the horizontal plane prependicular to the x-ray axis 20 may be substantially less than FY, FIG. 2, but for example FY', FIG. 6, may still be equal to or greater than the circumferential dimension FX of the focus region 17 which is indicated in FIG. 2. The beam delimiting aperture 21, FIG. 6, of a primary radiation diaphragm may be of conventional size, and may have a lateral dimension approximately equal to or greater than dimension FX of the focus region 17 and may have a longitudinal dimension between edges 22 and 23 greater than dimension FY'. Where the focus region 17 is to produce a flat planar fan-shaped x-ray beam 25, FIG. 6, with a central axis 20, the image region 27 may have a dimension of ten or twenty inches or more, while the thickness dimension of the flat fan beam 25 may correspond to that used in computer tomography or digital imaging in conventional radiography, e.g. one millimeter or less up to about ten millimeters. With respect to digital imaging, reference is made to an article "The digital imaging technique in conventional radiology: present and future possibilities" in *Electromedica,* volume 52, number 1, 1984, pages 2–12.

Where an x-ray image sensing means 28 comprises an x-ray image intensifier screen (e.g. of an x-ray image intensifier-video camera systems the aperture 21 may be circular with a diameter of about FX, FIG. 2, the dimension FY', FIG. 6, being equal to FX. Where the image sensing means 28 is a sheet film or a frame of a serial film with a given length to width ratio, the dimensions FY' and FX may ponding ratio, and the aperture 21 may be rectangular with a corresponding length to width ratio. By adapting the focus size and shape to the required size of aperture 21 for respective different film sizes or frame sizes, the heating of the anode is minimized for a given x-ray beam intensity. By modulating the electron beam intensity e.g. as shown at b in FIG. 5, nonuniformity of x-ray emission from different parts of the focus region 17 may be compensated. Where beam intensity is to be increased for a given exposure, the deflection excursions UX and UY can be reduced slightly to compensate for the tendency of the electron beam to spread at higher electron beam currents. Thus, if the electron spot 4*a* tends to increase its size by ten percent for a given increase in electron beam intensity, the deflection excursion values UX and UY can be reduced by ten percent to cover the same focus region 17 as with the lesser electron beam intensity.

As indicated in FIG. 5, the electron beam 4 can be turned off at 30 by applying a negative potential to the grid 16 at the end of each pulse at 15, FIG. 1. The electron beam may be off for a brief interval 31, FIG. 5, after which a further pulse at input 15, FIG. 1, may produce a further x-ray pulse initiated by a rising potential at grid 16 as indicated at 32, FIG. 5. The further grid potential variation Uf may correspond to a or b during successive exposure intervals T, as indicated at 33*a*, 33*b*. For example the trailing edge of each pulse at input 15 may switch off the analog gate at the output of the grid control digital to analog converter and activate a second analog gate for supplying cut-off potential to grid 16. During the beam cut-off intervals such as 31, the deflection potential Ux may be held at a value 34, FIG. 3, and the deflection potential Uy may execute a retrace excursion 35, FIG. 4. During the electron beam cut-off intervals, the film at image region 27 may be indexed or changed; or a patient at 36 may be indexed longitudinally along an axis indicated at 37 (e.g. for the case of a flat fan beam); or a TV camera associated with an x-ray image intensifier may execute a retrace cycle, or the like. Thus, each exposure interval T may have a duration of twenty milliseconds or less, for example.

In computer tomography, twenty slices may be scanned in a few minutes, and the x-ray beam may be pulsed e.g. 360 times in a rotation of the x-ray tube about a longitudinal patient axis such as indicated at 37. An actual scan may require about one second, so that in this case each exposure interval T would be less than three milliseconds.

It will be apparent that many modifications and variations may be made without departing from the scope of the teachings and concepts of the present invention.

I claim as my invention:

1. A method of effecting an x-ray exposure in an x-ray diagnostic system comprising a cathode for supplying an electron beam, and anode having a surface on which said electron beam is incident, and a deflection system for deflecting the electron beam said method comprising:

focussing said electron beam to a point, directing the focussed electron beam to impinge on a focal region of the anode which is smaller in comparison to said anode surface to produce x-ray emission therefrom at the start of an x-ray exposure, rotating the anode to move successive sectors of the anode surface into said focus region for distributing thermal loading of said electron beam on said anode, and during the x-ray exposure controlling said deflection system to move said focussed electron beam along a path within the focal region to produce a resultant pulse of x-ray energy during said x-ray exposure.

2. The method of claim 1, further comprising controlling said deflection system to vary the rate of movement of the electron beam along said path during said x-ray exposure.

3. The method of claim 1, further comprising controlling said deflection system to move the electron beam along said path such that the electron beam covers the focus region at least once during said x-ray exposure.

4. The method of claim 1, further comprising controlling said deflection system to move the electron beam along said path such that the electron beam covers the focus region an integral number of times during said x-ray exposure.

5. The method of claim 1, further comprising controlling said deflection system to move the electron beam along said path such that the electron beam covers the focus region a plurality of times during said x-ray exposure.

6. A method of effecting an x-ray exposure in an x-ray diagnostic system comprising a cathode for supplying an electron beam, an anode having a surface on which said focussed beam is incident and a deflection system for deflecting the focussed electron beam, said method comprising:

focussing said electron beam to a point, rotating said anode and directing the focussed electron beam to impinge on a focal region of the anode surface which is small in comparison to said anode surface to produce x-ray emission therefrom at the start of an x-ray exposure, during the x-ray exposure controlling said deflection system to move said focussed electron beam along a path within the focal region to produce a resultant pulse of x-ray energy during said x-ray exposure, and controlling said deflection system to vary the rate of movement of the focussed eletron beam along said path during said x-ray exposure.

7. An x-ray generator comprising:

means for generating an electron beam;

means for focussing said electron beam to a point;

a rotating anode having a surface on which said focussed electron beam is incident;

means for deflecting said focussed electron beam disposed between said means for generating said electron beam and said surface of said rotating anode;

control means for said means for deflecting for controlling deflection of said electron beam during an x-ray exposure to move said electron beam along two axes such that said electron beam follows a non-punctiform continuous path on said anode surface within a focal region of said anode surface which is substantially smaller than said surface; and an evacuated housing containing at least a portion of said means for generating said electron beam, said means for focussing said electron beam, said means for deflecting said electron beam, and said rotating anode.

8. An x-ray generator as claimed in claim 7, wherein said means for deflecting comprises first and second pairs of plates through which said focussed electron beam respectively passes, said first set of plates disposed for moving said focussed electron beam in one of said two directions, and said second pair of plates being disposed for moving said electron beam in the other of said two directions.

9. An x-ray generator comprising:

means for generating an electron beam;

means for focussing said electron beam to a point;

a rotating anode rotatable about a first axis, said rotating anode having a surface on which said focussed electron beam is incident;

first deflection means disposed between said means for focussing said electron beam and said surface of said anode for moving said electron beam along a second axis;

second deflection means disposed between said means for focussing said electron beam and said anode surface for moving said focussed electron beam along a third axis, said first, second and third axes being orthogonally disposed;

control means for said first and second means for deflecting said electron beam for moving said electron beam along said second and third axes during an x-ray exposure so that said electron beam follows a selected non-punctiform, continuous path on said anode surface within a selected focal region of said anode surface which is substantially smaller than said anode surface; and an evacuated housing containing at least a portion of said means for generating said electron beam, said means for focussing said electron beam, said first and second means for deflecting said electron beam, and said rotating anode.

* * * * *